United States Patent [19]

Wright

[11] 3,985,277

[45] Oct. 12, 1976

[54] WEB HANDLING DEVICE

[75] Inventor: Allen T. Wright, Webster, N.Y.

[73] Assignee: Xerox Corporation, Stamford, Conn.

[22] Filed: Mar. 26, 1975

[21] Appl. No.: 562,369

[52] U.S. Cl. ..... 226/177; 226/183; 226/187

[51] Int. Cl.[2] ..... B65H 17/22

[58] Field of Search ..... 226/176, 177, 183, 187

[56] References Cited

UNITED STATES PATENTS

| | | | |
|---|---|---|---|
| 1,438,674 | 12/1922 | Trumm | 226/183 |
| 2,153,214 | 4/1939 | Tondreau | 226/183 X |
| 2,637,561 | 5/1953 | Connell | 226/183 X |
| 3,330,458 | 7/1967 | Bentzman | 226/177 X |
| 3,459,354 | 8/1969 | Land | 226/177 |

*Primary Examiner*—Richard A. Schacher
*Attorney, Agent, or Firm*—James J. Ralabate; Michael H. Shanahan; Max J. Kenemore

[57] ABSTRACT

A web forwarding device wherein a web is friction driven by a drive means associated with a web pressure backing roll and a pair of pressure arms. The amount of wrap and tension around the backing roll is controlled by a pair of free floating pivotally mounted and interconnected pressure arms which hold the web on the roll. The pressure arms are adjustably mounted to control the distance between the axis of rotation of the roll and the pivot point.

6 Claims, 3 Drawing Figures

WEB HANDLING DEVICE

BACKGROUND OF THE INVENTION

This invention relates to web drive means and more particularly to a means for controlling the wrap angle and tension of a web over a drive roller.

In various apparatus, web surfaces are employed to either carry a separate substrate or a coating on the web which is to be acted upon within the apparatus. In most instances, drive rollers are employed to provide the motive force for pulling the web through the apparatus. In order to achieve the proper tension over the drive roller and thereby the proper amount of friction, a capstan is normally employed. In many instances, a capstan has been found to be undesirable either because of the lack of an ability to adjust continuously the tension on the drive roller or the coating on the web will not withstand the contact required with the capstan device.

There has been devised various mechanisms for controlling the wrap angle and tension of a web over a roller for purposes other than to provide friction for driving the web. For example, a web positioning apparatus is disclosed in U.S. Pat. No. 3,172,187 which comprises a pair of rollers on arms extended between a pair of drive rolls, each roller being urged against the web. As the pressure arms are pivoted away from each other, the wrap angle of the web around one of the drive rolls decreases until no contact at all is permitted between the web and one of the rolls.

A similar device is described in U.S. Pat. No. 3,591,151 wherein a pair of arms carrying rollers is positioned on a fulcrum within the circumference of a heated drying roll. The web is threaded over the rollers on the arms at the entry and exit points from the roll. By pivoting the arms, the amount of wrap around the roll is controlled in accordance with the circumference distance between the rollers on each arm. In this way, a web may be dried by conducting the web over the hot roll for a distance to be determined variably by the position of a pair of rollers at the circumference of the drying roller. Similarily, an apparatus for uniformly heating a band shaped material is disclosed in U.S. Pat. No. 2,972,668 wherein a pair of arms are extended on each side of a drying roll over which a band or web is threaded such that the amount of contact with the drying roll is controlled by extending the distance between the two arms in an arcuate path thereby withdrawing the band from contact with the roll.

While the prior art devices accomplish the objectives variously set forth, there are some processes employing web members wherein a constant drive means is essential depending upon different thicknesses of the webs and the kind of material carried by the webs. Accordingly, there is now provided an improved web forwarding means which avoids the disadvantages found in the prior art.

SUMMARY OF THE INVENTION

An object of this invention is to provide a web forwarding means which provides constant wrap angle and tension of a web through a drive means.

Another object of this invention is to provide a web forwarding means which is adjustable so as to provide a constant drive means independent of the thickness of the web.

Another object of this invention is to provide a continuously adjustable web forwarding means.

In accordance with this invention, there is provided a web forwarding means comprising a drive means, a web pressure backing roll, a pair of pivotally mounted and interconnected pressure arms extending tangentially adjacent each side of said backing roll. The arms preferably carry rollers which make contact with the web and thereby produce the amount of tension and friction in the system required to drive the web. By mounting the arms on a free floating pivot point, it has been found that constant tension over the backing roll is maintained because the arms are interconnected and any movement of one arm is compensated by an equal and opposite movement of the other arm. The amount of wrap of the web around the backing roll is controlled by making the pivot point adjustably mounted with respect to the axis of rotation of the backing roll and also by making the interconnection between the pressure arms adjustable. Through experience, it has been found to be expedient to supply a tension force between the pressure arms to urge the arms in one direction thereby making the interconnection between the arms highly controllable in both directions. The amount of tension must exceed the tension desired to be placed on the web.

The above and other features and advantages of the present invention will become more apparent from the following description of illustrative preferred embodiments thereof taken in conjunction with the accompanying drawings.

DETAILED DESCRIPTION OF THE DRAWINGS

Figure 1:
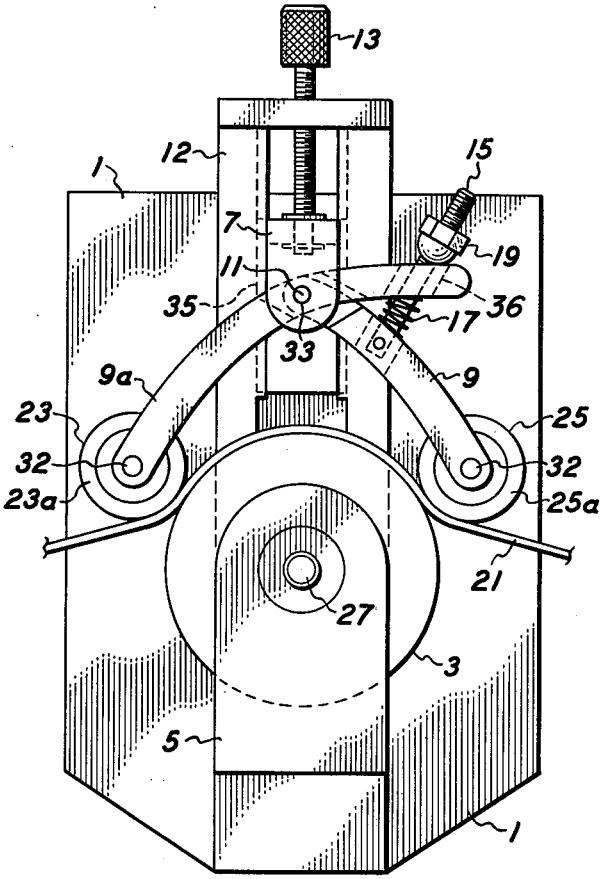
FIG. 1 is a front elevation of a fundamental embodiment of the present invention.

Referring to FIG. 1, there is shown backing plate 1 on which is mounted web pressure backing roll 3 in yoke 5. Above roll 3, there is mounted yoke 7 supporting pressure arms 9 and **9*a* at pivot means 11. Yoke 7 is supported by adjustment screw 13 threaded through a portion of channel support member 12 which extends outwardly over roll 3 and is supported by backing plate 1. Pressure arms 9 and 9*a* are interconnected by means of stud 15 which is pivotally secured to arm 9 and passes through an elongated hole 36 in arm 9*a*. The respective positions of arms 9 and 9*a* are maintained by the opposing forces of compressed spring 17 mounted concentric with stud 15 and lock nut 19. Alternatively, a contracting spring can be placed between pressure arms 9 and 9*a* below pivot means 11. Spring 17 may be replaced by a lock nut or other fastening means on stud 15 so as to hold pressure arms 9 and 9*a* at a fixed relative position. Preferably, spring 17** is employed to provide for relaxed tolerances in apparatus construction.

In operation, web 21 is threaded between pressure roller 23 and roll 3, and exits between pressure roller 25 and roll 3. Any suitable contact means can be employed to engage web 21 with pressure arms 9 and **9*a*. For example, arcuate shoes may be substituted for rollers 23 and 25. However, rollers such as are shown in FIG. 1 are preferred because of the reduction in friction between web 21 and pressure arms 9 and 9*a*. Also, a resilient layer is preferably provided on rollers 23** and 25 indicated in FIG. 1 as 23*a* and 25*a*. Such resilient layers protect web 21 from wear.

The position of rollers 23 and 25 in the horizontal plane is adjusted by the setting of lock nut 19 working against compressed spring 17. As lock nut 19 is threaded toward spring 17 rollers 23 and 25 separate farther apart as the pressure arms 9 and 9*a* pivot at pivot means 11. One purpose of spreading rollers 23 and 25 apart is to allow pivot means 11 to be lowered toward roll 3 and thus extend the amount of wrap of web 21 around roll 3. Rollers 23 and 25 are separated so as to allow the pressure arms to be lowered below the axis of roll 3. Pivot means 11 is positioned by rotating adjustment screw 13 in its threaded position in yoke 7. Once below the rotational axis of roll 3, the pressure arms can be adjusted toward each other by threading lock nut 19 away from compressed spring 17. The force of spring 17 drives rollers 23 and 25 toward roll 3 through pivot means 11.

Because pressure arms 9 and 9*a* are interconnected they are self compensating in operation. For example, should roller 25 become coated undesirably by material on web 21, it will be forced away from roll 3. Roller 23 will then move an equal distance toward roll 3. Web tension may increase at rollers 23 and 25 but such increase in web tension is not transmitted, in most instances, upstream from roller 23 along web 21.

Figure 2:
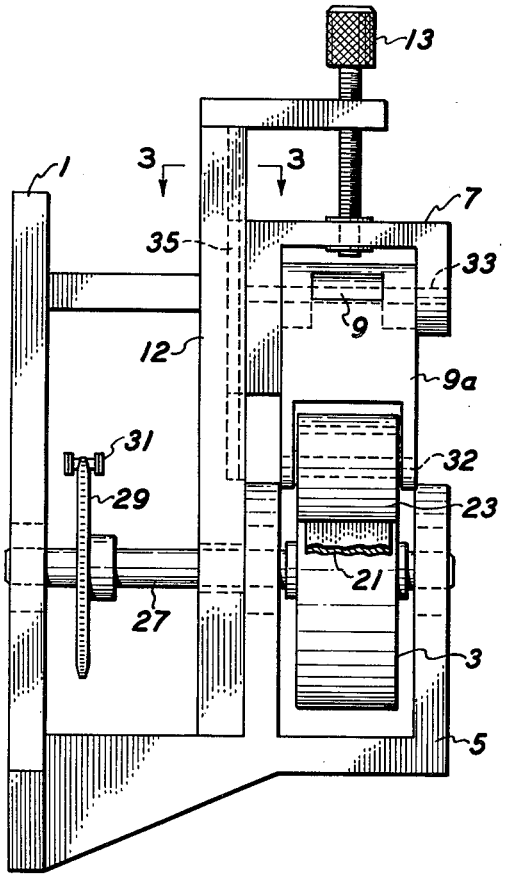
FIG. 2 is a side elevation of the embodiment described in FIG. 1.

Turning now to FIG. 2, there is shown a side view of the apparatus of FIG. 1. Thus, there is shown backing plate 1 on which is mounted yoke 5. Roll 3 is mounted on axle 27 supported by bearings in yoke 5 and backing plate 1 and is, in this embodiment, associated with drive means including sprocket 29 and chain 31. Chain 31 is associated with a power source not shown. Other alternative drive means can be employed such as a direct drive motor on axle 27 or synchronized motors on rollers 23 and 25. Alternatively, the drive means can be associated with rollers 23 and 25 by extending their axles to support, for example, sprocket 29. In the embodiment wherein rollers 23 and 25 are driven by a drive means, they are optimally associated by suitable gear train or chain drive. In this way, both rollers 23 and 25 will rotate synchronously. Web pressure backing roll 3 may also be included in such a gear train or chain drive thus making all of roll 3, rollers 23 and 25 associated with the drive means.

Figure 3:
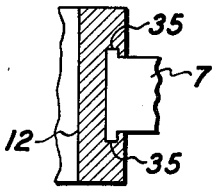
FIG. 3 is a section taken along lines 3—3 of FIG. 2.

Upper yoke 7 supports shaft 33 on to which is pivotally mounted pressure arms 9 and 9*a*. Pressure arm 9*a* contains a window into which pressure arm 9 resides so as to provide a common pivot point. Yoke 7 is mounted in keyway 25 thereby stabilizing it. The mounting of yoke 7 in keyway 35 is shown in more detail by FIG. 3.

Referring again to FIG. 2, web 21 is shown entering between roll 3 and roller 23 on pressure arm 9*a*. Roller 23 is attached to arm 9*a* through shaft 32.

In accordance with this invention, there is provided a highly versatile web forwarding means which is capable of providing constant pressure on a web as it passes through a drive mechanism. Another feature of this invention is the capability of interchanging roll 3 with different size rolls while retaining the tensioning device. Suitable adjustment is provided in both the vertical and horizontal planes to render the roll interchangeable with respect to size. Thus, the resultant velocity of the web being driven by roll 3 may conveniently be altered.

Other modifications and ramifications of the present invention will occur to those skilled in the art upon a reading of the present disclosure. These are intended to be included within the scope of this invention.

What is claimed is:

1. Web forwarding apparatus comprising a pressure roll mounted for rotation having a peripheral surface suitable for drivingly engaging the web to be forwarded, two pressure arms pivotally mounted about a common pivot means with a nonpivoted end of each arm extending tangentially toward the roller to guide the web to be forwarded into contact with at least a portion of the periphery of the pressure roll, bias means coupled to the pressure arms outside the region between the arms, the pivot means and the pressure roll to urge the arms toward one another into contact with the periphery of the pressure roll and yoke means supporting said common pivot means adapted to be moved radially to and from the axis of rotation of the pressure roll to change the amount of contact between the web being forwarded and the periphery of the pressure roll.

2. The web forwarding apparatus of claim 1 wherein the pressure arms are interconnected by a threaded stud pivotally attached to one of the arms, extending through the other of said arms and including an adjustably positionable lock nut adapted to limit the relative motion of the arms.

3. The web forwarding apparatus of claim 1 wherein at least one of the pressure arms includes a roller means at the point of contact with the web.

4. The web forwarding means of claim 3 wherein said roller means is provided with a resilient surface in contact with the web.

5. The web forwarding means of claim 1 including a drive means which drives the pressure roll.

6. The web forwarding means of claim 3 including a drive means which drives said roller means.

* * * * *

UNITED STATES PATENT AND TRADEMARK OFFICE

CERTIFICATE OF CORRECTION

PATENT NO. : 3,985,277

DATED : October 12, 1976

INVENTOR(S) : Allen T. Wright

It is certified that error appears in the above-identified patent and that said Letters Patent are hereby corrected as shown below:

In column 3, line 52, delete "25" and substitute --35--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*